United States Patent [19]

Spatz

[11] 4,033,700

[45] July 5, 1977

[54] DISPENSER FOR FLUENT MATERIAL

[75] Inventor: Walter B. Spatz, Pacific Palisades, Calif.

[73] Assignee: Spatz Corporation, Venice, Calif.

[22] Filed: Feb. 2, 1976

[21] Appl. No.: 654,034

[52] U.S. Cl. ..... 401/180

[51] Int. Cl.[2] ..... B43K 5/06

[58] Field of Search ..... 401/170, 180; 222/321, 222/340, 380, 382; 239/331, 333

[56] References Cited

UNITED STATES PATENTS

| | | | |
|---|---|---|---|
| 3,088,636 | 5/1963 | Spatz | 222/215 X |
| 3,471,065 | 10/1969 | Malone | 222/340 X |
| 3,560,100 | 2/1971 | Spatz | 401/180 |
| 3,746,261 | 7/1973 | Nozawa | 222/384 X |
| 3,790,034 | 2/1974 | Horvath | 239/333 X |
| 3,797,748 | 3/1974 | Nozawa et al. | 222/340 X |

*Primary Examiner*—Lawrence Charles
*Attorney, Agent, or Firm*—Subkow and Kriegel

[57] ABSTRACT

A roll-on dispenser comprises a generally tubular barrel having an open forward end and a generally tubular ball-carrying member having an open rear end which is slidably received in the chamber of the barrel. The ball-carrying member has a ball applicator rollably mounted in its forward end. The rear end of the barrel is vented to the atmosphere, and a one-way follower device is slidably disposed in the barrel chamber for forward sliding movement. A cap is adapted to be threaded on the ball-carrying member and, when screwed thereon, pulls the ball-carrying member forwardly in the barrel chamber to increase the effective volume of the chamber and create a partial vacuum or sub-atmospheric pressure therein, whereupon the atmospheric pressure in the rear end of the barrel chamber will force the one-way follower forwardly by a distance corresponding to the volume of fluent material previously dispensed. When the cap is screwed on the ball-carrying member it causes compression of a compression spring to store energy therein. When the cap is removed the compression spring expands to release its stored energy and force the ball-carrying member rearwardly in the barrel chamber to pressurize the fluent material in the chamber.

22 Claims, 5 Drawing Figures

DISPENSER FOR FLUENT MATERIAL

FIELD OF THE INVENTION

The present invention relates to dispensers, and more particularly, to dispensers capable of being held in the hand for applying fluent material, such as fluent body deodorant, for example, to a desired surface (such as a portion of the human body, for example).

BACKGROUND OF THE INVENTION

Various types of dispensers for fluent materials have been devised. For example, U.S. Pat. No. 3,560,100 discloses a roll-on applicator having a ball at the forward end thereof which rotates or rolls when moved against the surface to which the fluent material is to be applied to transfer the material from the ball to the desired surface (such as a portion of the human body, for example). The dispenser is provided with a cap and a spring-biased piston which, upon removal of the cap, is spring-biased to a position wherein it maintains a continuous pressure against the fluent material to be dispensed and applied.

U.S. Pat. No. 3,088,636 shows a fluent material dispenser (for toothpaste, for example) having a deformable head portion of a pliant, elastic material which, when despressed, will discharge the material to be dispensed through a discharge outlet. After dispensing a desired quantity of the fluent material, the discharge head is allowed to spring back to its initial shape, thereby producing a partial vacuum in the dispenser. Atmospheric pressure in the rear end of the dispenser will then force a one-way follower device in the dispenser chamber in a forward direction against the fluent material in the chamber, resulting in a decrease in the effective internal volume of the dispenser chamber.

Co-pending U.S. patent application No. 597,829, filed July 21, 1975, discloses a pump device for dispensing fluids. This pump device includes a cap which, when screwed onto the pump means, compresses a compression spring to store energy therein. Removal of the cap preparatory to use releases the energy stored in the compression spring to pressurize the fluid to be dispensed so that fluid can be sprayed upon operation of a dispensing actuator.

SUMMARY OF THE INVENTION

It is an object of the present invention to provide a dispenser for fluent materials and the like which is more efficient in use and less expensive to manufacture and assemble than fluent material dispensers of the prior art.

The dispenser of the present invention employs resilient energy storing means (for example, a helical compression spring) and a one-way follower device for permitting dispensing of a fluent material through an applicator (such as, for example, a roll-on type applicator) in a novel and more efficient manner than dispensers which have heretofore been devised. The dispenser of the present invention includes a rear container member and a forward container member slidably disposed relative to one another and having communicating chambers therein defining a composite chamber in which the fluent material to be dispensed and applied is stored. The rear container member has its rear end vented to atmosphere, and the forward container member has dispensing means (such as a rotatable or rollable ball, for example) at its forward end. A one-way follower device, including a piston member, is disposed in the rear container member. Resilient means (such as a compression spring, for example) normally biases the forward container member rearwardly, relative to the rear container member to create a partial vacuum or sub-atmospheric pressure in the composite chamber of the forward and rear container members. The one-way follower in the rear container member will be forced forwardly by means of atmospheric pressure acting on its rear portion to reduce the volume in the composite chamber by an amount corresponding to the volume of the fluent material previously dispensed.

Other objects and advantages of the present invention will become apparent from a consideration of a preferred embodiment shown in the drawings and described in the following portion of the specification.

BRIEF DESCRIPTION OF THE DRAWINGS

In the drawings:

FIG. 1*b* shows the rear end portion of the dispenser and FIG. 1*a* shows the remainder of the dispenser.

DETAILED DESCRIPTION OF A PREFERRED EMBODIMENT

Figures 1A, 1B, 2, 3, 4:
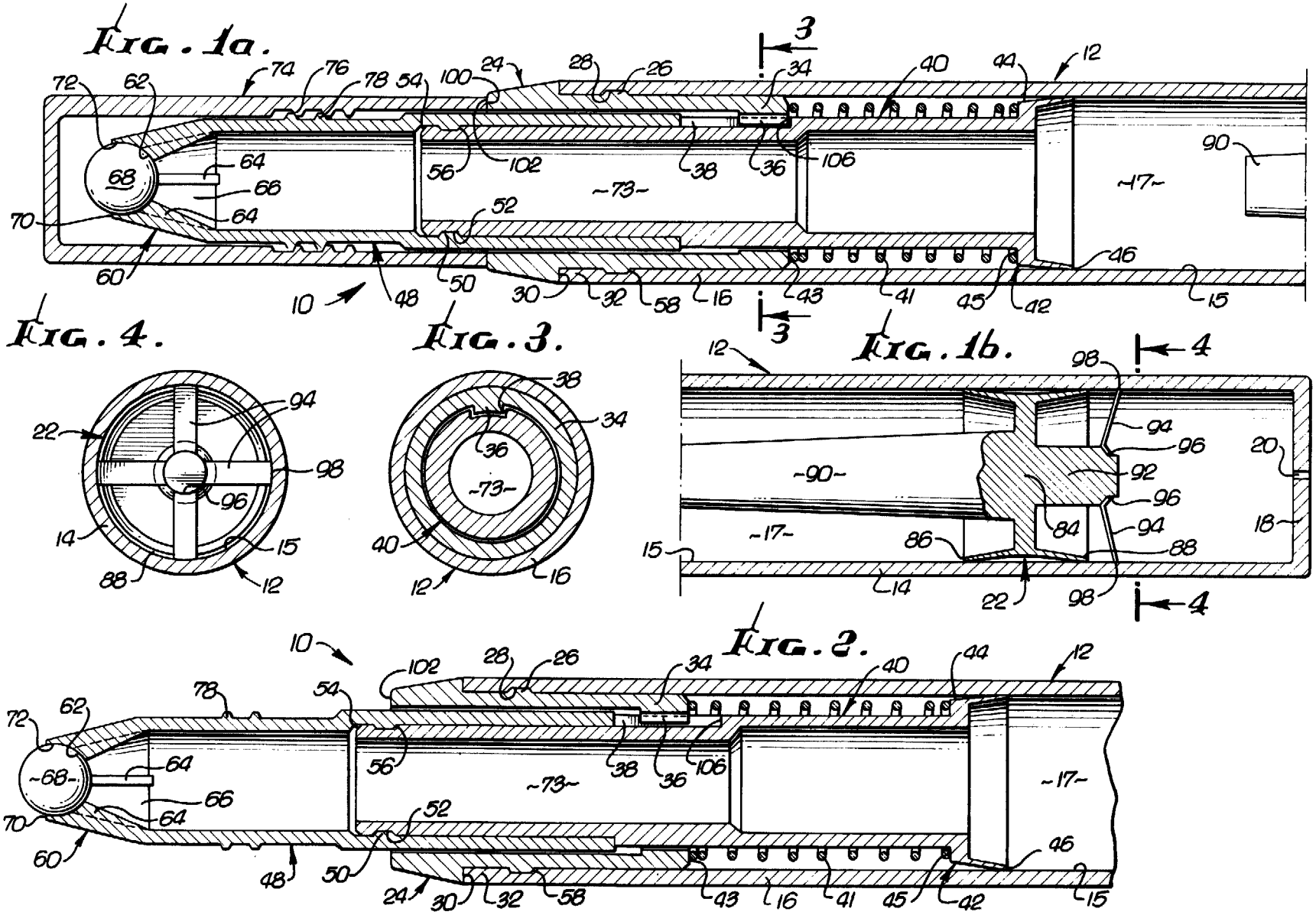
FIGS. 1*a* and 1*b* are longitudinal section views of a preferred embodiment of a dispenser constructed in accordance with the teachings of the present invention, with a cap disposed over the forward end portion of the dispenser and with the forward portion of the dispenser in its extended position.
FIG. 2 is a longitudinal section view of the embodiment of the present invention shown in FIG. 1 with the cap removed, the forward portion of the dispenser in a retracted position, and the rear end portion of the dispenser broken away.
FIG. 3 is a cross-section taken along the line 3—3 of FIG. 1*a*.
FIG. 4 is a cross-section taken along the line 4—4 of FIG. 1*b*.

In the preferred embodiment of the present invention specifically illustrated in the Figures, a dispenser 10 includes an elongate barrel 12 comprising a rear barrel portion 14 and a forward barrel portion 16. The interior peripheral wall 15 of the barrel 12 defines a chamber 17 which is adapted to contain a fluent material (for example, deodorant) to be dispensed and applied. A rear end wall 18 at the rear end of the barrel 12 is provided with a hole or air vent 20 which permits air at atmospheric pressure to enter the rear portion of the chamber 17 and act upon a one-way follower device 22.

The forward barrel portion 16 of the elongate barrel 12 has a generally tubular fitting 24 mounted thereon by means of an external circumferential rib 26 on the fitting 24 which is received within a companion internal circumferential groove 28 in the forward portion of the internal peripheral wall 15 of the barrel 12. The barrel 12 and the fitting 24 on the forward end thereof constitute a rear container or rear container means.

It is contemplated that the rib 26 and groove 28 connection may be sufficiently tight so as to prevent relative rotational movement between the barrel 12 and the fitting 24.

The forward portion of the fitting 24 is provided with a rearwardly facing shoulder 30 which receives and contacts the forward end 32 of the barrel 12. The rear end portion 34 of the fitting 24 is provided with a radially inwardly projecting tongue or flange 36 which is received in a longitudinally extending groove 38 in the external peripheral wall of a generally tubular slide member 40 which is slidably received in the chamber 17 of the barrel 12.

The tubular slide member 40 is provided with a piston 42 on the rear end thereof. The piston 42 has a tapered outer peripheral surface 44 and a rearwardly facing lip seal 46 conforming to the circumference of the interior peripheral wall 15 of the barrel 12 so as to provide a substantially fluid-tight, sliding fit therebetween.

An elongated, generally tubular ball-carrying member 48 is mounted on the forward portion of the slide member 40 by means of an internal circumferential rib 50 on the interior peripheral wall of the ball-carrying member 48 which is received within a companion external circumferential groove 52 formed in the exterior peripheral wall of the forward end of the slide member 40. The slide member 40 and the ball-carrying member 48 connected thereto constitute a forward container or forward container means.

It is contemplated that the rib 50 and groove 52 connection may be sufficiently tight to prevent relative rotational movement between the slide member 40 and the ball-carrying member 48.

A compression spring 41 is disposed around the rear portion of the slide member 40, between the rear end 43 of the fitting 24 and a forwardly facing shoulder 45 on the piston 42 of the slide member 40 for normally biasing the slide member 40 and the attached ball-carrying member 48 rearwardly in the chamber 17 of the barrel 12, as shown in FIG. 2.

The ball-carrying member 48 and the slide 40 are preferably made of an elastic or plastic material, such as polypropylene. Accordingly, when the forward end of the slide member 40, which has the external circumferential groove 52 formed therein, is inserted into the ball-carrying member 48, the forward end of the slide member 40 will be deformed sufficiently to permit the internal circumferential rib 50 to snap into the external circumferential groove 52. The outer peripheral portion 54 of the forward end of the slide member 40 is bevelled and cooperates with the bevelled rear face 56 of the internal circumferential rib 50 to cam the forward end of the slide member 40 inwardly until the internal circumferential rib 50 snaps into the companion external circumferential groove 52.

Similarly, the barrel 12 and the fitting 24 on the forward barrel portion 16 are preferably made of an elastic or plastic material. Accordingly, when the fitting 24 is inserted into the forward end of the barrel 12, the forward end 32 will deform sufficiently to permit the external circumferential rib 26 on the fitting 24 to snap into the internal companion circumferential groove 28 in the forward end of the barrel 12. The rear face of the external circumferential rib 26 is bevelled at 58 to facilitate camming of the forward end 32 of the barrel outwardly until the external circumferential rib 26 snaps into the companion internal circumferential groove 28.

The ball-carrying member 48 has a nose portion 60 at its forward end. Circumferentially spaced ribs 64 are provided on the interior wall of the nose portion 60 and define feed channels 66 therebetween. The forward faces 62 of the ribs 64 are generally arcuate shaped, and the interior peripheral wall 72 adjacent the forward end 70 of the ball-carrying member 48 is continuous and also arcuate shaped. Thus, the arcuate forward ends 62 of the ribs 64 and the continuous arcuate interior peripheral wall 72 adjacent the forward end 70 of the ball-carrying member 48 cooperate to define a spherical seat. A rollable or rotatable element, such as a ball 68, for example, bears against this spherical seat 62, 72 and is rollable therein. The ball 68 is retained contiguous the spherical seat 62, 72 by the extreme end 70 of the nose 60 which extends around the center of the ball 68 and has an internal diameter which is slightly less than the diameter of the ball.

As seen in FIG. 1*a* and 2, the connected ball-carrying member 48 and slide member 40 have an internal chamber 73 formed therein which communicates with the chamber 17 in the barrel 12 to form a composite chamber for containing fluent material to be dispensed.

There is a predetermined and comparatively small clearance between the continuous arcuate interior wall portion 72 of the nose 60 and the ball 68 to permit the fluent material coating the ball 68 to pass to the exterior of the nose 60 as the ball rolls in its seat 62, 72.

A cap or cover member 74 is secured over the forward portion of the ball-carrying member 48 by means of internal screw threads 76 formed in the interior peripheral wall of the cap 74 and external mating threads 78 formed on the exterior peripheral surface of the ball-carrying member 48.

As shown in FIG. 1*b*, the one-way follower device 22 disposed in the chamber 17 of the barrel 12 includes a piston 84 which slidably fits within the interior wall 15 of the barrel 12. The piston 84 has a forwardly facing lip seal 86 and a rearwardly facing lip seal 88, each of which conforms to and forms a substantially fluid-tight fit with the interior peripheral wall 15 of the barrel 12.

The piston 84 has a forwardly extending shaft 90 and a rearwardly projecting boss 92 integrally connected thereto. A plurality of circumferentially-spaced latch fingers or arms 94 have their inner ends 96 connected to the boss 92. The latch fingers or arms 94 extend radially outwardly and rearwardly of the boss 92 so that the outer ends 98 of the fingers or arms 94 engage the interior peripheral wall 15 of the barrel 12. These fingers or arms 94 are in the nature of leaf springs and can deflect to permit forward motion of the one-way follower device 22, but which grip the interior peripheral wall 15 of the barrel 12 to prevent rearward motion of the piston 84 and the entire one-way follower device 22.

FIGS. 1*a* and 1*b* show the relative positions of the barrel 12, the fitting 24 on the forward end of the barrel, the slide member 40 and the ball-carrying member 48 when the cap 74 is secured on the ball-carrying member 48. FIG. 2 shows the relative positions of the barrel 12, the fitting 24, the slide member 40 and the ball-carrying member 48 when the cap 74 is removed. By comparing FIGS. 1*a* and 2, it will be seen that as the internally threaded cap or cover member 74 is screwed onto the externally threaded ball-carrying member 48, the rear end 100 of the cap 74 will engage the forward end 102 of the fitting 24. Since the user will be screwing the cap 74 on the ball-carrying member 48 with one hand while holding the barrel 12 stationary in his other hand, or vice versa, relative rotational movement between the cap 74 and the barrel 12 after the rear end 100 of the cap 74 has contacted the forward end 102 of the fitting 24 will result in pulling the ball-carrying member 48 and the slide member 40 forwardly, against the force of the compression spring 41, to create a partial vacuum of sub-atmospheric pressure within the chamber 73 and that portion of the barrel chamber 17 forwardly of the one-way follower device 22. Since, as noted above, the clearance between the continuous arcuate interior wall portion 72 adjacent the forward end 70 of the ball-carrying member 48 and the ball 68 is comparatively small the ball 68 and the fluent material between the outer surface of the ball and the arcuate wall or seat 72 restrict and substantially prevent ambient air from entering the chamber 73 when the partial vacuum is created.

Since a partial vacuum or sub-atmospheric pressure is created within the chamber 73 and that portion of the barrel chamber 17 forwardly of the one-way follower device 22, atmospheric pressure acting on the rear surface of the follower device 22 via the air vent 20 will force the one-way follower device 22 forwardly in the chamber 17 of the barrel 12 by a distance corresponding to the volume of the fluent material that has been dispensed and applied by the ball 68.

When the cap or cover member 74 is removed from the ball-carrying member 48, the compression spring 41 will move the slide member 40 and the attached ball-carrying member 48 rearwardly to a position such as shown in FIG. 2. As the slide member 40 and the ball-carrying member 48 move to a retracted position (such as shown in FIG. 2) the fluent material in the chamber 73 and that portion of the chamber 17 forwardly of the one-way follower device 22 will be pressurized to force the fluent material to be dispensed against the portion of the exterior surface of the ball 68 which is disposed within the interior of the nose portion 60 of the ball-carrying member 48. The latch fingers or arms 94 on the rear end of the follower device 22 will engage the interior peripheral wall 15 of the chamber 17 to prevent rearward movement of the follower device 22 by the pressure created in the chambers 17 and 73. This pressurization of the fluent material to be dispensed facilitates coating of the exterior surface of the ball 68 as it rotates to apply the fluent material to the desired surface. Thus, the combination of the cap 74, the compression spring 41 and the piston 42 on the rear end of the slide member 40 constitute pump means for the fluent material in the dispenser.

After the dispenser 10 has been used (for example, by applying deodorant or some other fluent material to a body surface or some other surface by means of the ball 68) the cap 74 is again screwed onto the ball-carrying member 78 to pull the ball-carrying member 48 and the connected slide member 40 forwardly to the position shown in FIG. 1*a*, wherein the rear end wall 106 of the slot 38 in the slide member 40 contacts the rear edge of the tongue 36. This will again result in the creation of a partial vacuum or sub-atmospheric pressure in the chamber 73 and in the portion of the chamber 17 forwardly of the one-way follower device 22, whereupon the atmospheric pressure acting on the rear of the one-way follower device via the air vent 20 will force the one-way follower device forwardly by a distance corresponding to the amount of fluent material previously dispensed.

The foregoing cycle will continue until the piston shaft 90 extends into the chamber 73 within the slide member 40 and the forwardly facing lip seal 86 of the piston 84 contacts the rearwardly facing lip seal 46 on the end of the enlarged head 42 on the rear end of the slide member 40.

From the foregoing description, it is apparent that the present invention provides a dispenser for fluent material wherein the fluent material is automatically fed in a forward direction by the follow-up action of the follower device under the influence of atmospheric pressure each time the cap 74 is screwed onto the ball-carrying member 48. It is unnecessary to manipulate any devices to cause the one-way follower to move in a forward direction with the dispenser. Substantially the full quantity of fluent material placed within the dispenser can be dispensed. Very little of the fluent material, if any, will be wasted. Accordingly, the volume of the fluent material actually dispensed is relatively great in proportion to the volume of the dispenser itself. In addition, the dispenser of the present invention provides automatic pressurization of the fluent material to be dispensed and applied each time that the cap 74 is removed to permit the spring 41 to expand and force the slide member 40 and the ball-carrying member rearwardly in the barrel chamber 17.

It is contemplated, of course, that numerous changes, modifications and additions can be made to the specific embodiment of the dispenser of the present invention disclosed in the drawings and described above. Accordingly, it is intended that the present invention be limited only by the scope of the appended claims.

I claim:

1. A dispenser for fluent material comprising:

a container for storing fluent material to be dispensed;

a dispenser member slidably disposed in said container, said dispenser member having a discharge outlet;

follower means in said container movable in a forward direction toward said discharge outlet;

resilient means engaging and normally urging said dispenser member rearwardly in said container to pressurize fluent material in said container between said follower means and said discharge outlet, and means for shifting said dispenser member forwardly in said container to energize said resilient means.

2. A dispenser as defined in claim 1, said container having vent means rearwardly of said follower means, whereby forward movement of said dispensing member creates sub-atmospheric pressure in said container forwardly of said follower means and forward movement of said follower means in said container under the influence of atmospheric pressure in said container rearwardly of said follower means.

3. A dispenser as defined in claim 2, wherein said resilient means comprises a spring disposed between said shifting means moving said dispenser member forwardly in said container to stress said spring.

4. A dispenser as defined in claim 3, wherein said shifting means comprises a cap member coupled to said dispenser member and covering said discharge outlet, said cap member being movable into engagement with said container to enable said spring to be energized and create relative movement between said container and said dispenser member to create sub-atmospheric pressure in said container.

5. A dispenser as defined in claim 1, wherein said resilient means comprises a compression spring disposed between said shifting means moving said dispenser member forwardly in said container to increase the compression of said spring and create sub-atmospheric pressure in said container forwardly of said follower means to effect movement of said follower means forwardly in said container.

6. A dispenser as defined in claim 5, wherein said shifting means comprises a cap member coupled to said dispenser member and covering said discharge outlet, said cap member being movable into engagement with said container to enable said spring to be energized and create relative movement between said container and said dispenser member to create sub-atmospheric pressure in said container.

7. A dispenser as defined in claim 1, wherein said follower means including means permitting said forward movement in said container but preventing rearward movement of said follower means in said container.

8. A dispenser as defined in claim 1, wherein one of said container or said dispenser member has a flange projecting radially therefrom and the other of said container or said dispenser member has means defining a longitudinally extending groove therein; said flange extending into said groove to permit only limited sliding axial movement of said dispenser member relative to said container.

9. A dispenser as defined in claim 8, wherein said flange is connected to said container and said longitudinally extending groove is in said dispenser member.

10. A dispenser as defined in claim 1, wherein said container comprises a generally cylindrical barrel having an open forward end, a rear end, an interior peripheral wall defining a generally cylindrical barrel chamber, a generally tubular fitting mounted on the forward end of said barrel, a rear end wall on the rear end of said barrel, and an opening in said rear end wall establishing fluid communication between the rear portion of said barrel chamber and the atmosphere.

11. A dispenser as defined in claim 1, wherein said dispenser member comprises a ball-retaining member; said ball-retaining member including a forward end and a circumferentially-continuous, generally arcuate shaped interior wall adjacent said forward end defining a seat; and a ball retained by and rollably disposed in said seat; said ball being so sized relative to said seat such that there is a predetermined and comparatively small clearance therebetween to permit fluent material coating the ball to pass to the exterior of the forward end of the ball-carrying member as the ball rolls in said seat.

12. A dispenser as defined in claim 1, wherein said dispenser member has an open forward end having surface means defining a seat for a rollable element; and a rollable element disposed in said seat for transferring fluent material from said container to a surface to be coated; said discharge outlet in said discharge member comprising a comparatively small clearance between the exterior surface of said rollable element and said surface means defining said seat.

13. A dispenser as defined in claim 1, wherein said dispenser member comprises a generally cylindrical slide member slidably disposed in said container and a generally cylindrical ball-retaining member mounted on the forward end of said slide member;

said ball-retaining member including a forward end and a circumferentially-continuous, generally arcuate shaped interior wall adjacent said forward end; said ball-retaining member further comprising a plurality of circumferentially-shaped ribs rearwardly of and directly adjacent said circumferentially-continuous, generally arcuate shaped interior wall; said circumferentially-spaced ribs having generally arcuate shaped forward surfaces contiguous said arcuate shaped interior wall and forming a spherical seat therewith; said circumferentially-spaced ribs defining feed channels therebetween; and a ball retained by and rollably disposed in said spherical seat; said ball member being so sized relative to said circumferentially-continuous, generally arcuate shaped interior wall such that there is a predetermined and comparatively small clearance therebetween to permit fluent material coating the ball to pass to the exterior of the forward end of the ball-carrying member as the ball rolls in said spherical seat.

14. A dispenser as defined in claim 1, wherein said dispenser member has a piston on the rear end thereof with a forwardly facing annular shoulder thereon; and said container has a generally annular, rearwardly facing surface; said resilient means comprising a compression spring extending between and engaging said forwardly facing annular shoulder on said piston of said dispenser member and said rearwardly facing end surface of said container.

15. A dispenser as defined in claim 1, said shifting means including a cover member for said dispenser member; said cover member and said dispenser member having mating screw threads thereon for screwing said cover member on said dispenser member; said cover member, when screwed on said dispenser member being adapted to engage said container and, upon continued rotation of said cover member, pull said dispenser member forwardly relative to said container to stress said resilient means and create sub-atmospheric pressure in said container forwardly of said follower means.

16. A dispenser as defined in claim 15, wherein said container includes means venting the portion of said container rearwardly of said follower means to the atmosphere, whereby atmospheric pressure will move said follower means forwardly in said container when said-atmospheric pressure is created in said container forwardly of said follower means.

17. A dispenser for fluent material comprising:

rear container means having an open forward end; said rear container means including means defining a rear chamber therein;

forward container means having an open rear end; said forward container means including means defining a forward chamber therein;

said open rear end of said forward container means being slidably disposed in said rear chamber;

said forward and rear chambers being in fluid communication with one another and forming a composite chamber for containing a fluent material to be dispensed;

said forward container means including dispensing means for selectively dispensing a desired quantity of a fluent material disposed in said composite chamber;

limiting means for limiting relative movement between said forward and rear container means;

said limiting means permitting limited relative movement of said forward and rear container means between an extended position and a retracted position;

biasing means normally biasing said forward and rear container means toward their said retracted position;

actuator means for moving said forward and rear container means to an extended position to create a sub-atmospheric pressure in said composite chamber; and follower means shiftable in said composite chamber and responsive to atmospheric pressure externally of said composite chamber to reduce the effective volume of said composite chamber;

said biasing means moving said forward and rear container means to said retracted position to pressure fluent material in said composite chamber.

18. A dispenser as defined in claim 17, wherein said forward container means has a forward end portion, and wherein said dispensing means includes an outlet in said forward end portion and a rollable element in said outlet for transferring fluent material from said forward chamber to the exterior of said outlet.

19. A dispenser as defined in claim 17, wherein said limiting means includes a longitudinally extending groove on one of said forward or rear container means and a tongue on said other of said forward or rear container means; extending into said groove.

20. A dispenser as defined in claim 17, wherein said actuator means comprises a cover chamber adapted to fit over said dispensing means and connected to said forward container means and to engageable with said real container means.

21. A dispenser as defined in claim 17, wherein said rear container means includes a rear end open to the atmosphere; and wherein said follower means comprises piston means slidably disposed in said rear chamber portion; said piston means being adapted to move forwardly in said rear chamber portion in response to the creation of sub-atmospheric pressure in said chamber.

22. A dispenser as defined in claim 17, wherein said biasing means comprises spring means disposed between and engaging said forward and rear container means.

* * * * *